US006464530B1

(12) United States Patent
Smith et al.

(10) Patent No.: US 6,464,530 B1
(45) Date of Patent: Oct. 15, 2002

(54) STRAIN RELIEF FOR CABLES

(75) Inventors: Peter Andrew Smith, Skelmorlie; Ian McFarlane Denny, Greenock; Joseph James Hall, Erskine, all of (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/699,594

(22) Filed: Oct. 30, 2000

(30) Foreign Application Priority Data

Nov. 6, 1999 (GB) ..... 9926241

(51) Int. Cl.[7] ..... H01R 13/58
(52) U.S. Cl. ..... 439/449; 439/942
(58) Field of Search ..... 439/942, 449, 439/371; 174/92, 135, 88 S, 72, 158 R; 248/74.1

(56) References Cited

U.S. PATENT DOCUMENTS 2,997,531 A * 8/1961 Oldham et al. ..... 174/158 R
4,029,896 A * 6/1977 Skinners ..... 174/92
5,363,539 A * 11/1994 Tisol ..... 248/64.1
5,547,391 A * 8/1996 Benes et al. ..... 439/399
5,554,053 A * 9/1996 Matthews ..... 439/942
5,653,411 A * 8/1997 Picco et al. ..... 248/64.1
6,217,385 B1 * 4/2001 Genta et al. ..... 439/942

* cited by examiner

*Primary Examiner*—Tulsidas Patel
*Assistant Examiner*—Phuong K Dinh
(74) *Attorney, Agent, or Firm*—Lawrence D. Cutter, Esq.; Heslin Rothenberg Farley & Mesiti P.C.

(57) ABSTRACT

A strain relief for a plurality of cables comprises two portions which act together to clamp the cables in position without the use of tools in a manner which is intuitive to a user. The first portion has hook elements projecting from a surface, each hook element being for retention of a cable. A second set of hook elements is also provided. A second portion has a cable receiving opening corresponding to the cable receiving opening in the first portion. The second portion latches to the first portion, so as to clamp the cables.

15 Claims, 2 Drawing Sheets

STRAIN RELIEF FOR CABLES

PRIOR FOREIGN APPLICATION

This application claims priority from United Kingdom Patent Office Application No. 9926241.2, filed Nov. 6, 1999.

1. Technical Field

The present invention relates to cable clamps for securing cables in data processing equipment and more particularly to cable clamps for securing a plurality of cables without the use of screws or tools.

2. Background Art

Conventionally clamps used to secure cables are "P" style clips, with a separate clip being required to secure each cable. Each cable is clamped individually using a separate clip and screw. Such "P" style clips need a driver, such as a screwdriver or a nutdriver, to be used in order that the cable be removed. This type of clamp has proved to be time consuming and costly to use and has resulted in poor control of the pressure being applied to the cables. The use of screws can result in too much pressure being applied on the wires which causes the insulation to split or break open and shorts to occur. Computer servers frequently have many cables exiting the computer enclosure and each of the cables must be clamped at the rear of the server. It has became evident that a strain relief device was required which was economical, simple to assemble, and which could be easily used without uncontrolled pressure being applied to the wires.

SUMMARY OF THE INVENTION

Accordingly, the present invention provides a strain relief for a plurality of cables, the strain relief comprising: a first portion having a first surface having a plurality of first hook elements projecting from the first surface, each hook element being for retention of one of the plurality of cables, the first surface having a plurality of second hook elements projecting from the first surface, each second hook element being for retention of said one of the cables; and a second portion having a cable receiving opening corresponding to the cable receiving opening in the first portion, the second portion latching to the first portion, so as to clamp the plurality of cables.

The use of a second closing portion having cable receiving openings, make the strain relief easy to use as no tools are required and the usage is intuitive. The elimination of the use of clamping screws used in the prior art allows for better control of the clamping pressure on the wires by the assembly. Simple snapping of the portions together with no adjustment required prevents ineffective clamping of the wires too loosely or clamping of the wires too tightly which would cause crushing of the wires and breaking of the insulation resulting in short circuits.

Preferably, each of the first hook elements are oriented in a first direction, each of the second hook elements are oriented in a second direction, the second direction being opposed to the first direction.

The use of oppositely directed hook elements improves the strength of the strain relief.

The hook elements are so formed so that they, not the snap on cover, resist any vertical pull force applied to the cable. This has the advantage that the cover and its latch do not have to be solidly constructed making them cheaper to make and easier to use.

Preferably, the strain relief further comprises a plurality of third and a plurality of fourth elements, projecting from the first surface, each of the third and fourth elements being located between the plurality of first hook elements and the plurality of second hook elements, each of the third and fourth elements having a cable receiving opening corresponding to each of the cable receiving openings in each of the first and second hook elements of the first portion.

Further preferably, the second portion of the strain relief is hingeably attached to the first portion at a first end of the first surface and, in use, is latchedly attached to the end of the first surface distal from the first end.

The second portion being a captive part has the advantage that it cannot be mislaid.

BRIEF DESCRIPTION OF THE DRAWINGS

Embodiments of the invention will now be described, by way of example, with reference to the accompanying drawings, in which.

BEST MODE FOR CARRYING OUT THE INVENTION

The invention will be described with reference to an embodiment which is suitable for the strain relief of six cables. The embodiment is intended to be fixed to the exterior surface of a server computer for strain relief of cables entering and exiting the server computer. The embodiment described is used to strain relieve the power cord, mouse cable, keyboard cable and USB port cables.

However, the invention is not restricted to usage for this purpose and many applications where multiple cables need to be secured without the use of tools and in such a way as operation of the strain relief is intuitive may be envisaged. Such applications are not intended to be restricted to usage for the restraint of cables associated with computers.

Figure 1:
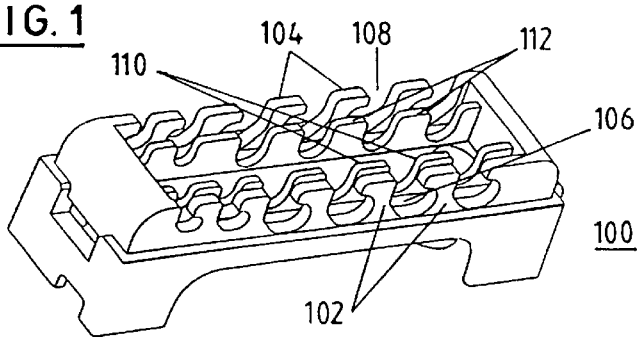
FIG. 1 is a perspective view of a first portion of a cable strain relief according to the present invention.
Figure 2:
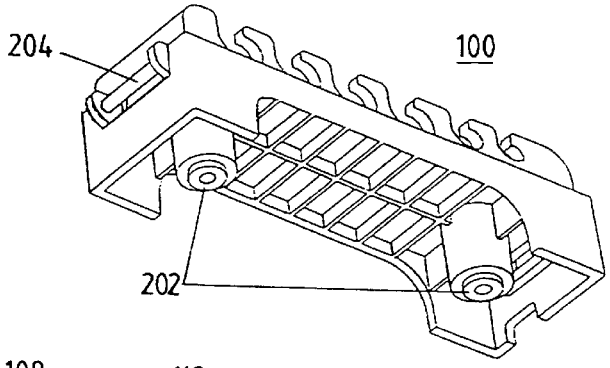
FIG. 2 is a perspective view of the cable strain relief portion of FIG. 1 showing the fixing holes.

FIGS. 1 and 2 show perspective views of the upper and lower surfaces of a first portion of a strain relief according to the present invention. Referring to FIG. 1, hook elements 102 are shown along one edge of the first portion 100 of the strain relief. There is a hook element 102 corresponding to each of the cables to be strain relieved. Similar hook elements 104 are located along the opposite edge of the first portion 100. When it is desired to insert a cable into the strain relief, it is first located within the cable receiving portion 106 located in the area surrounded in part by a hook element 102. The cable is then located within the corresponding cable receiving portion 108 of the hook element 104 located on the opposite edge of the first portion 100. Since the direction of the hook element 102 is opposite to that of hook element 104, the cable tends to remain located in place without further action until it is fixed in place. Such location is achieved without the use of any tools.

Also shown in FIG. 1 are further, optional, locating elements 110, 112, projecting from the first portion which act to assist the location of the cable. These locating elements have cable receiving openings corresponding to each of the cable receiving openings in the hook elements, but the locating elements do not have the "hook" feature.

The locating elements force the cable to "snake" through these elements and enable it to resist any force trying to pull the cable through the cable clamp.

Referring to FIG. 2, the lower surface of the first portion can be seen. The lower surface may optionally contain locating and/or fixing elements 202 for locating and/or fixing the first portion to, for example, a computer housing. The first portion may be manufactured from a material which has medium tensile strength. A suitable material is moulded ABS thermoplastic polymer. Various stiffening and/or strengthening ribs can be seen in FIG. 2 which may be required dependent on the stiffness and/or strength of the material used to fabricate the first portion. Such ribs are not essential to the invention and the design of any such ribs is well known to a person skilled in the art.

Figure 3:
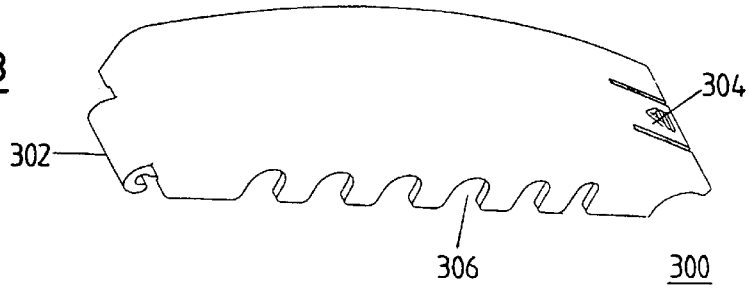
FIG. 3 is a perspective view of a second portion of a cable strain relief according to the present invention.

FIG. 3 shows a view of the upper surface of the second portion 300 of the strain relief. The second portion 300 has a cable receiving opening 306 corresponding to each of the cables to be strain relieved. A hinge mechanism 302 is provided that cooperates with hinge mechanism (204 in FIG. 2) in order to allow the second portion of the strain relief to be hingeably connected with the first portion 100 of the strain relief. The hinge mechanism allows the second portion 300 to rotate relative to first portion 100 whilst remaining attached to the first portion 100. Also shown in FIG. 3 is a latching portion which is operated in order to retain the second portion 300 in position at the end of the first portion 100 distal from the hinge mechanism.

Figure 4:
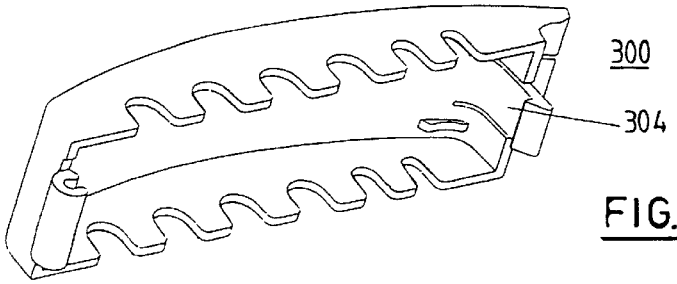
FIG. 4 is a perspective view of the cable strain relief portion of FIG. 3 showing the fixing holes.

FIG. 4 shows a view of the lower surface of the second portion 300 of the strain relief. The interior surfaces of the latch 304 can be seen in this view. The latch is preferably such that it does not require any parts which are not part of the moulding of the second portion 300, but the invention is not intended to be restricted to such implementations.

Figure 5:
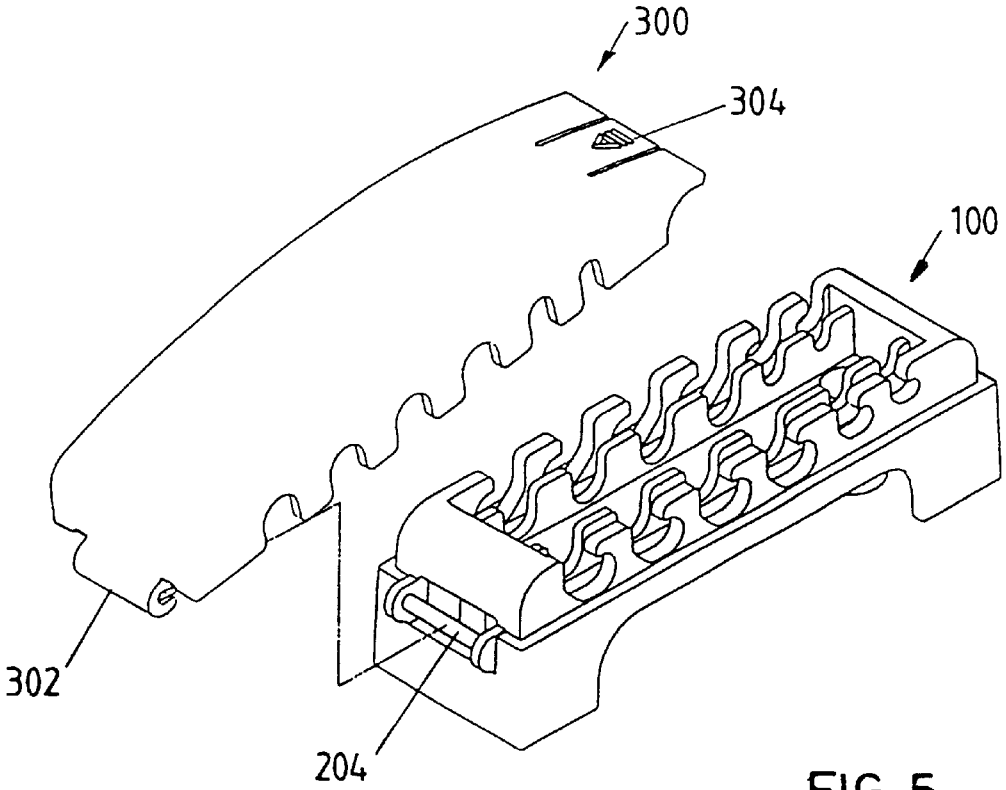
FIG. 5 is a perspective view showing the interconnecting relationship between the portions of FIGS. 1 and 3 of the cable strain relief according to the present invention.

FIG. 5 shows both the first and second portions of the strain relief assembly as they are being assembled. The hinge part 302 of the second portion is located in position onto the hinge part 204 of the first portion 100. The first portion is then hinged to an open position, the cables inserted into the cable receiving openings and the second portion moved to a closed position where the latch 304 engages with the first portion so as to lock the two portions together and clamp the cables in position.

The features of the present invention make the strain relief easy to use as no tools are required, the usage is intuitive, and the second portion is a captive part so that it cannot be mislaid. Thus, an effective strain relief is provided for the wires to prevent breaking of any solder connections or dislocation of any connector when the cable is pulled. The elimination of the use of clamping screws in the present invention allows for better control of the clamping pressure on the wires by the assembly. The size of the member and its cable receiving opening is made to accommodate the size of cable and conductor wires to be relieved. Simple snapping of the portions together with no adjustment required prevents ineffective clamping of the wires too loosely or clamping of the wires too tightly which would cause crushing of the wires and breaking of the insulation resulting in short circuits.

While the invention has been particularly shown and described with reference to a preferred embodiment thereof, it will be understood by those skilled in the art that various changes in form and detail may be made therein without departing from the spirit and scope of the invention.

What is claimed is:

1. A strain relief for a plurality of cables, couplable to a data processing device, the strain relief comprising:

a first portion having a first surface having a plurality of first hook elements projecting from the first surface, each first hook element being for releasable retention of one of the plurality of cables when present, the first surface having a plurality of second hook elements projecting from the first surface, each second hook element being for releaseable retention of said one of the cables when present;

said first portion comprising a plurality of cable receiving openings, each cable receiving opening being at least partially bounded by at least one of a first hook element of said plurality of first hook elements and a second hool element of said plurality of second hook elements; and a second portion having a plurality of cable receiving openings corresponding to the plurality of cable receiving openings in the first portion, the second portion latching to the first portion, so as to clamp the plurality of cables when present.

2. A strain relief as claimed in claim 1, wherein each of the first hook elements are oriented in a first direction, each of the second hook elements are oriented in a second direction, the second direction being opposed to the first direction.

3. A strain relief as claimed in claim 2, further comprising a plurality of third and a plurality of fourth elements, projecting from said first surface, each of the third and fourth elements being located between the plurality of first hook elements and the plurality of second hook elements, each of the third and fourth elements having a cable receiving opening corresponding to each of the cable receiving openings in each of the first and second hook elements of the first portion.

4. A strain relief as claimed in claim 2, wherein the second portion is hingeably attached to the first portion at a first end of the first surface and, in use, is latchedly attached to the end of the first surface distal from the first end.

5. A strain relief as claimed in claim 2, wherein the first surface further comprises fixing locations.

6. A strain relief as claimed in claim 2, wherein the second portion is fabricated from steel.

7. A strain relief as claimed in claim 2, wherein the first portion is fabricated from steel.

8. A method of relieving strain on a plurality of cables, the method comprising:

providing a body, wherein the body comprises a plurality of first hooks, a plurality of second hooks, and a plurality of cable receiving openings, wherein each cable receiving opening of the plurality of cable receiving openings is at least partially bounded by at least one of a first hook of the plurality of first hooks and a second hook of the plurality of second hooks, and wherein each hook of the plurality of first hooks and each hook of the plurality of second hooks is adapted to releasably retain at least one cable of the plurality of cables when the at least one cable is present;

placing at least one cable between at least one first hook of the plurality of first hooks and at least one second hook of the plurality of second hooks, thereby relieving strain on the at least one cable; and latching a cover to the body to clamp the at least one cable.

9. The method of claim 8, wherein the plurality of first hooks face a first direction and the plurality of second hooks face a second direction, and wherein the first direction is opposite from the second direction.

10. The method of claim 8 wherein the cover comprises a plurality of second cable receiving openings adapted to correspond to the cable receiving openings.

11. A strain relief for a plurality of cables, said strain relief comprising:

a first portion comprising a first surface having a plurality of hooks projecting from said first surface;

said first portion comprising a plurality of cable receiving openings, each cable receiving opening being at least partially bounded by at least one hook of said plurality of hooks;

each hook of said plurality of hooks adapted to resist a stress placed on at least one cable of the plurality of cables to cause the at least one cable to be retained in at least one cable receiving opening of the plurality of cable receiving openings, when the at least one cable is present; and a cover having a plurality of cover cable receiving openings corresponding to the plurality of cable receiving openings in the first portion, said cover adapted to latch to the first portion to clamp the at least one cable, when the at least one cable is present in the at least one cable receiving opening.

12. The system of claim 11, wherein a plurality of first hooks of said plurality of hook elements face a first direction and a plurality of second hooks of said plurality of hook elements face a second direction, and wherein said first direction is opposite from said second direction.

13. The system of claim 12, wherein said each first hook of said plurality of first hooks comprises a first cable receiving opening and each second hook of said plurality of second hooks comprises a second cable receiving opening, and wherein said first cable receiving opening and said second cable receiving opening are adapted to receive said at least one cable.

14. The system of claim 11, further comprising a plurality of locating elements, each of said plurality of locating elements comprising a locating cable opening located between a first hook of said plurality of first hooks and a second hook of said plurality of second hooks.

15. The strain relief of claim 11, wherein said plurality of hooks comprises a plurality of first hooks and a plurality of second hooks, each of said plurality of first hooks is oriented in a first direction and each of said plurality of second hooks is oriented in a second direction and said first direction is opposite from said second direction.

* * * * *